United States Patent [19]

Atsumi et al.

[11] Patent Number: 4,551,983

[45] Date of Patent: Nov. 12, 1985

[54] REFRIGERATION APPARATUS

[75] Inventors: Akira Atsumi; Kensaku Oguni, both of Shimizu; Takao Senshu, Niihari; Hirokiyo Terada, Shizuoka; Kazuo Yoshioka, Shimizu, all of Japan

[73] Assignee: Hitachi, Ltd., Tokyo, Japan

[21] Appl. No.: 621,374

[22] Filed: Jun. 18, 1984

[30] Foreign Application Priority Data

Jun. 17, 1983 [JP] Japan ..... 58-107655

[51] Int. Cl.[4] ..... F25B 41/00

[52] U.S. Cl. ..... 62/174; 62/324.4; 62/509

[58] Field of Search ..... 62/174, 324.4, 509

[56] References Cited

FOREIGN PATENT DOCUMENTS 54-24347 2/1979 Japan ..... 62/509

58-22657 2/1983 Japan .

*Primary Examiner*—William E. Wayner

*Assistant Examiner*—John Sollecito

*Attorney, Agent, or Firm*—Antonelli, Terry & Wands

[57] ABSTRACT

A refrigeration apparatus has a refrigerant circuit which is constituted by a compressor, a condenser, a first pressure reducer, a gas-liquid separator, a second pressure reducer and an evaporator connected to one another in series. The refrigeration apparatus also has a gas injection line connected between a gaseous phase portion of the gas-liquid separator and a compression chamber of the compressor. The improvement comprises a liquid refrigerant extracting passage providing a communication between a portion of the gas-liquid separator at a predetermined level and a portion of the low-pressure side of the refrigerant circuit. With this arrangement, it is possible to stabilize the level of the liquid refrigerant in the gas-liquid separator.

14 Claims, 9 Drawing Figures

REFRIGERATION APPARATUS

BACKGROUND OF THE INVENTION

The present invention relates to a refrigeration apparatus for use in an air conditioner and, more particularly, to a refrigeration apparatus having a gas injection line.

Generally, a refrigeration apparatus having a gas injection line includes a refrigerant circuit which is constituted by a compressor, condenser, first pressure reducer, gas-liquid separator, second pressure reducer and an evaporator which are connected in series to form a closed circuit for refrigerant. The gas injection line has a pipe which is connected at its one end to the gaseous phase portion of the gas-liquid separator while the other end is connected to the cylinder chamber (compression chamber) of the compressor under compression stroke.

The gaseous refrigerant of high pressure discharged from the compressor is introduced into the condenser and is liquefied in the condenser to become liquid refrigerant through heat exchange with a fluid such as air or water which also is made to flow through the condenser. The liquid refrigerant from the condenser is decompressed to an intermediate pressure as it flows through the first pressure reducer so that a part of the refrigerant is evaporated into gaseous phase. The gaseous and liquid phases of the refrigerant are introduced into the gas-liquid separator and are separated from each other. The liquid phase of the refrigerant is discharged from the liquid phase portion of the separator, and is introduced into the evaporator after a decompression to a predetermined low pressure through the second pressure reducer. In the evaporator, the liquid refrigerant is evaporated as it absorbs heat from the fluid such as air or water which also is made to flow through the evaporator. The evaporated refrigerant is then returned to the compressor. On the other hand, the gaseous phase of the refrigerant, which has been separated from the liquid phase and accumulated in the upper part of the gas-liquid separator, is injected into the compression chamber of the compressor under compression stroke through the gas injection line thereby increasing the heating or cooling power of the air conditioner incorporating the refrigeration apparatus.

Japanese Utility Model Laid-Open No. 22657/1983 discloses a refrigerant circuit having a gas injection line of the type mentioned as above. This refrigerant circuit suffers a problem that, when the load is changed to reduce the difference of pressur between the high-pressure side and the low-pressure side, the liquid level in the gas-liquid separator is raised to undesirably allow the liquid refrigerant to come into the gas injection line, partly because the dryness of the refrigerant coming into the gas-liquid separator is reduced and partly because the flow rate of the refrigerant through the second pressure reducer is decreased. Consequently, the liquid refrigerant is injected into the compressor to cause problems such as an increased power demand by the compressor and, in the worst case, a breakdown of the compressor. The reduced flow rate of the refrigerant through the second pressure reducer undesirably increases the degree of superheating of the refrigerant gas at the evaporator outlet, resulting in a reduction of the cooling or heating power.

In some air conditioners, an outdoor unit having the compressor, condenser, first pressure-reducer and the gas-liquid separator is installed on a lower floor of a house, while an indoor unit having the second pressure reducer, evaporator and so forth are installed on an upper floor so that both units are connected through pipes of considerably large lengths. In such a case, the refrigerant pressure at the inlet to the second pressure reducer is lowered due to a pressure drop along the long pipes so that the flow rate of the refrigerant is decreased undesirably. Since the liquid refrigerant in the gas-liquid separator is saturated, bubbles of refrigerant gas are mingled in the liquid refrigerant separated by the gas-liquid separator as a result of the pressure drop mentioned above, and this pressure drop is further increased by the bubbles of the refrigerant gas. This also increases the tendency of the rise of the liquid level in the gas-liquid separator to undesirably permit the liquid refrigerant to be injected into the compressor through the gas injection line. At the same time, the flow rate of the refrigerant through the evaporator is decreased to reduce the cooling power of the refrigeration cycle.

SUMMARY OF THE INVENTION

Accordingly, it is an object of the invention is to provide a refrigeration apparatus in which the level of the liquid refrigerant in the gas-liquid separator is maintained substantially constant regardless of the change of the load, thereby to prevent liquid refrigerant from coming into the compression chamber of the compressor through the gas injection line.

It is another object of the invention to provide a refrigeration apparatus in which the flow rate of the refrigerant through the second pressure reducer is optimized to prevent reduction of cooling or heating power of an air conditioner incorporating the refrigeration apparatus.

To these ends, according to one aspect of the invention, there is provided a refrigeration apparatus having a refrigerant circuit constituted by a compressor, a condenser, a first pressure reducer, a gas-liquid separator, a second pressure reducer and an evaporator which are connected to one another in series, and a gas injection line connected between a gaseous phase portion of the gas-liquid separator and a compression chamber of the compressor, characterized by comprising a liquid refrigerant extracting passage providing a communication between a portion of the gas-liquid separator at a predetermined level and a portion of the low-pressure side of the refrigerant circuit.

According to another aspect of the invention, there is provided a refrigeration apparatus having a refrigerant circuit, the circuit comprising: a refrigerant passage constituted by a series connection of a compressor, a four-way valve, an outdoor heat exchanger, a second heating pressure reducer with a first check valve connected in parallel thereto, a first cooling pressure reducer, a first heating pressure reducer, a second cooling pressure reducer with a second check valve connected in parallel thereto, and an indoor heat exchanger through pipes; a gas-liquid separator connected through an inlet pipe to the passage between the first cooling pressure reducer and the first heating pressure reducer; pipes having third and fourth check valves and leading from the bottom of the gas-liquid separator to an inlet pipe to the second cooling pressure reducer and to an inlet pipe to the second heating pressure reducer, respectively; an injection line connected between a gaseous-phase portion of the gas-liquid separator and a compression chamber of the compressor; a stop valve means disposed in the inlet pipe to the gas-liquid separator and adapted to be opened and closed, respectively, when gas injection to the compressor is made and not made; a change-over means for changing over the four-way valve so as to selectively connect discharge and suction pipes of the compressor to the outdoor heat exchanger and the indoor heat exchanger in such a manner that, when the refrigeration apparatus operates in the cooling mode, a refrigerant passage is formed to connect the outlet side of the outdoor heat exchanger to the gas-liquid separator through the first check valve, first cooling pressure reducer and the stop valve means, and also to connect the bottom portion of the gas-liquid separator to the second cooling pressure reducer through the third check valve whereas, when the refrigeration apparatus operates in the heating mode, a refrigerant passage is formed to connect the outlet side of the indoor heat exchanger to the gas-liquid separator through the second check valve, first heating pressure reducer and the stop valve means and also to connect the bottom portion of the gas-liquid separator to the second heating pressure reducer through the fourth check valve; a first bypass passage means which forms, when the refrigeration apparatus operates in the cooling mode without the gas injection, a passage directly connecting the first cooling pressure reducer to the second cooling pressure reducer bypassing the gas-liquid separator; and a second bypass passage means which forms, when the refrigeration apparatus operates in the heating mode, a passage which directly connects the first heating pressure reducer to the second heating pressure reducer bypassing the gasliquid separator; wherein the improvement comprises an accumulator disposed in the suction pipe of the compressor; and a liquid refrigerant extraction passage connected at its one end to the gas-liquid separator to open at a predetermined level in the gas-liquid separator and at the other end to a portion of the low-pressure side of the refrigerant circuit; the pipe leading from the bottom portion of the gas-liquid separator to the third and fourth check valves being arranged in the accumulator in such a manner that heat is exchanged between the refrigerant flowing through the pipe leading from the bottom portion of the gas-liquid separator and the refrigerant in the accumulator.

As stated above, the refrigeration apparatus of the invention has a liquid extraction passage which provides a communication between a portion of the gas-liquid separator at a predetermined level from the bottom thereof and the low-pressure side of the refrigerant circuit. In the normal state of operation in which the level of the liquid refrigerant in the gas-liquid separator is comparatively low, the flow-rate of the refrigerant flowing through the liquid extraction passage is extremely small because this refrigerant is in the gaseous phase.

When the refrigerant pressure at the inlet of the second pressure reducer comes low due to, for example, a reduction of the load, the liquid level in the gas-liquid separator is raised so that liquid refrigerant starts to flow through the liquid extraction passage and the flow rate of refrigerant in this passage is increased by several times of that obtained when the gaseous phase of the refrigerant flows through the passage. Consequently, the refrigerant decompressed by the pressure reducers is sucked by the compressor to eliminate any rise of the liquid level in the gas-liquid separator and, hence, an excessive increase of the degree of superheating of the refrigerant at the evaporator outlet.

According to the invention, therefore, it is possible to maintain an optimum liquid level in the gas-liquid separator regardless of the load fluctuation to avoid any abnormal rise of the liquid level thereby preventing the injection of the liquid refrigerant into the compressor through the injection line.

In an embodiment of the invention in which the liquid refrigerant from the gas-liquid separator is super-cooled by the extracted liquid refrigerant, the flow rate of the refrigerant in the second pressure reducer is increased because only liquid phase of the refrigerant can flow through this second pressure reducer. Consequently, the rise of the liquid level in the gas-liquid separator is further suppressed to ensure the optimum liquid level in the same.

DESCRIPTION OF THE PREFERRED EMBODIMENTS

Figure 1:
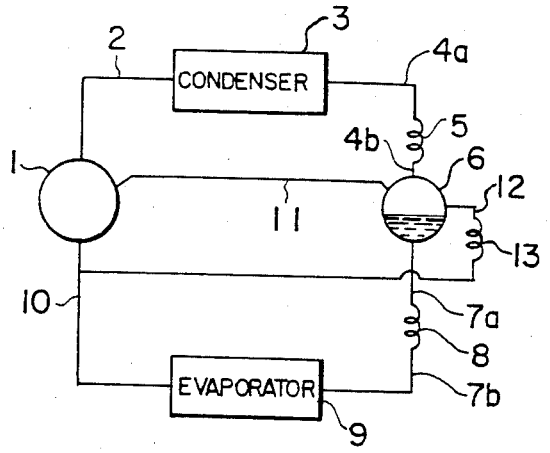
FIG. 1 is a refrigerant circuit diagram of an embodiment of the refrigeration apparatus of the invention.

An embodiment of the invention will be described hereinunder with reference to FIG. 1 which is a refrigerant circuit diagram of this embodiment.

A compressor 1 is connected at its delivery or discharge side to a condenser 3 through a discharge pipe 2. The condenser 3 is connected at its outlet side to a first pressure reducer 5 such as a capillary tube through a pipe **4*a* and further to a gaseous phase portion formed at the upper portion of the space in a gas-liquid separator 6 through a pipe 4*b*. The gas-liquid separator 6 is connected at its outlet side to a second pressure reducer 8 such as a capillary tube through a pipe 7*a* and further to an evaporator 9 through a pipe 7*b*. The evaporator 9 is connected at its outlet side to the compressor 1 through a suction pipe 10. A gas injection pipe or line 11 is connected at its one end to the gaseous phase portion of the gas-liquid separator 6, while the other end thereof is connected to a compression chamber under compression of the compressor 1. A liquid refrigerant extraction pipe 12 opens at its one end to a portion of the gas-liquid separator 6 at a predetermined intermediate height from the bottom of the separator. The other end of the liquid refrigerant extraction pipe 12 is connected to the suction pipe 10 of the compressor 1 through a pressure reducer 13**.

The pressurized gaseous refrigerant discharged from the compressor 1 flows into the condenser 3 and is condensed to become liquid refrigerant through a heat exchange with a fluid such as air or water which is also supplied to the condenser 3. The liquid refrigerant from the condenser 3 is decompressed to an intermediate pressure by the first pressure reducer 5 so that a part of this refrigerant is evaporated. The mixture of the gaseous phase and liquid phase of the refrigerant is introduced into the gas-liquid separator 6 in which both phases of the refrigerant are separated from each other. The liquid phase of the refrigerant then flows out of the liquid phase portion of the gas-liquid separator 6 and is introduced into the evaporator 9 after a decompression down to a predetermined low pressure by means of the second pressure reducer 8. The liquid refrigerant is then evaporated in the evaporator to become gaseous refrigerant through heat absorption from a fluid such as air or water which is also supplied to the evaporator 9. The evaporated refrigerant is then returned to the compressor 1. On the other hand, the gaseous phase of the refrigerant separated from the liquid phase and accumulated in the upper portion of the gas-liquid separator 6 is injected into the compression chamber of the compressor 1 through the gas injection line 11, thereby to increase the heating or cooling power of the air conditioner incorporating the refrigeration apparatus.

In the normal state of operation of the refrigeration apparatus, the refrigerant pressure at the inlet to the second pressure reducer 8 is sufficiently high and the liquid level in the gas-liquid separator 6 is low. In this state, only the gaseous phase of the refrigerant flows through the pressure reducer 13 so that the flow rate of the refrigerant in the pressure reducer 13 is extremely small. However, as the refrigerant pressure at the inlet to the second pressure reducer 8 is lowered due to, for instance, a reduction of the load, the liquid level in the gas-liquid separator 6 is raised so that liquid refrigerant starts to flow from the gas-liquid separator 6 to the pressure reducer 13. In this state, the flow rate of the refrigerant in the pressure reducer 13 is several times as large as that attained when only the gaseous phase of the refrigerant flows in the pressure reducer 13. The refrigerant decompressed to a low pressure by the pressure reducer 13 as well as the gaseous refrigerant in the evaporator outlet is sucked by the compressor 1 so that the liquid level in the gas-liquid separator 6 is not raised nor the degree of super-heating of the refrigerant at the compressor inlet is increased.

Thus, the liquid level in the gas-liquid separator 6 is maintained substantially unchanged despite the load fluctuation and any change of condition such as a difference in mounting height between an in-door unit and an out-door unit which tends to cause a change in the liquid level, and a substantially constant degree of superheating of the refrigerant is obtained at the compressor inlet.

Figure 2:
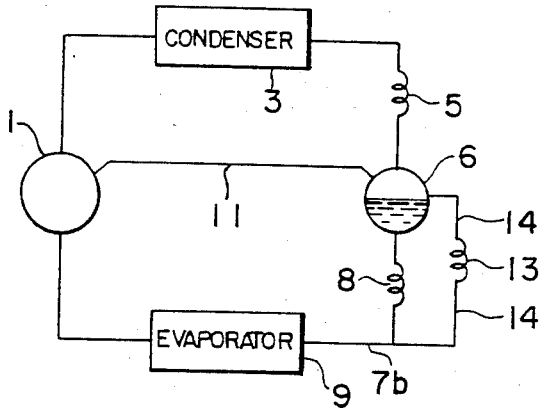
FIG. 2 is a refrigerant circuit diagram of another embodiment of the refrigeration apparatus of the invention.

FIG. 2 shows another embodiment in which the end of the liquid refrigerant extraction pipe 14 adjacent to the evaporator is connected to the inlet pipe **7*b* of the evaporator 9. In this case, the flow rate of the refrigerant into the evaporator 9 is increased to provide a greater rate of absorption of heat. Other portions are materially identical to those of the embodiment shown in FIG. 1** and, therefore, are denoted by the same reference numerals and detailed explanation is omitted.

Figure 3:
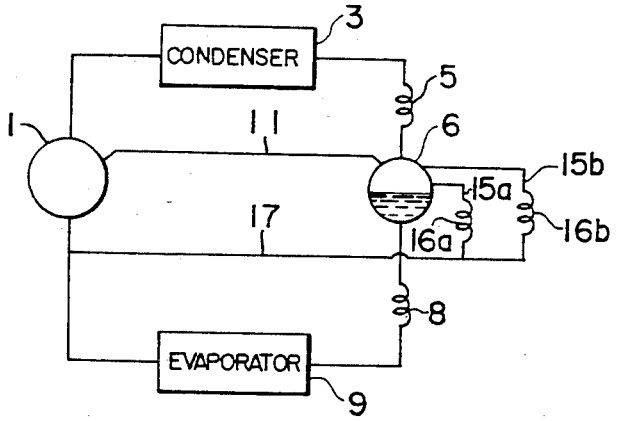
FIG. 3 is a refrigerant circuit diagram of still another embodiment of the refrigeration apparatus of the invention.

FIG. 3 shows still another embodiment in which a plurality of liquid refrigerant extraction pipes represented by pipes **15*a* and 15*b* are provided. These liquid refrigerant extraction pipes 15*a* and 15*b* are connected to portions of the gas-liquid separator 6 of different levels, through respective pressure reducers 16*a* and 16*b*. According to this arrangement, it is possible to enhance the precision of control of the liquid level in the gas-liquid separator 6. Other portions are materially identical to those of the embodiment shown in FIG. 1** and are denoted by the same reference numerals with the detailed explanation omitted.

Figure 4:
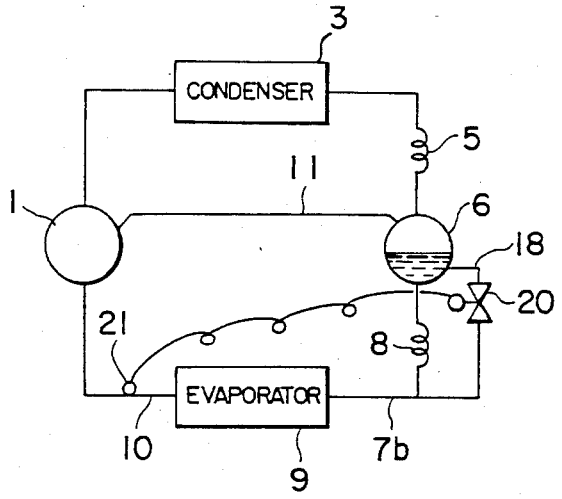
FIG. 4 is a refrigerant circuit diagram of a further embodiment of the refrigeration apparatus of the invention.

FIG. 4 shows a further embodiment in which an expansion valve 20 is used as a pressure reducer in the liquid refrigerant extraction pipe 18 which has one end connected to the inlet side of the evaporator 9. The expansion valve 20 has a feeler bulb 21 connected to the outlet pipe 10 of the evaporator 9 for sensing the temperature of the refrigerant. According to this embodiment, it is possible to attain a precise control of the degree of superheating of the refrigerant at the outlet side of the evaporator 9. Other portions are materially identical to those of the embodiment shown in FIG. 1 and are denoted by the same reference numerals with the detailed explanation thereof omitted.

Figure 5:
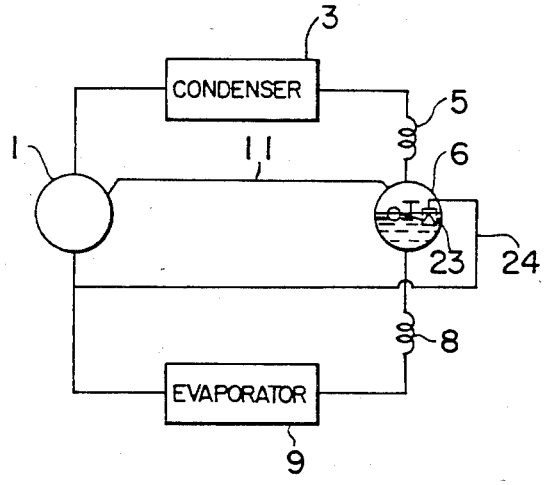
FIG. 5 is a refrigerant circuit diagram of a still further embodiment of the refrigeration apparatus of the invention.

FIG. 5 shows a still further embodiment in which a float valve 23 is disposed as a pressure reducer in the gas-liquid separator 6, and a pipe 24 is connected to the valve portion of the float valve 23. This embodiment can ensure a precise control of the liquid level in the gas-liquid separator, because the level control is conducted upon direct sensing of the liquid level. Other portions are materially identical to those of the embodiment shown in FIG. 1 and, hence, are denoted by the same reference numerals with the detailed explanation thereof omitted.

Figure 6:
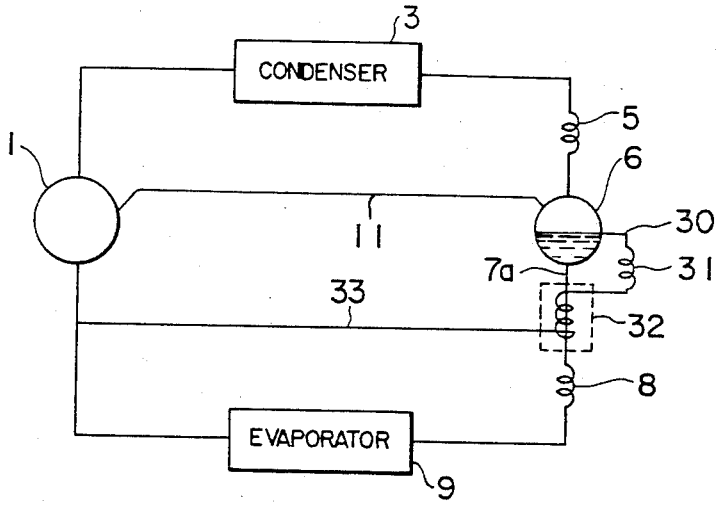
FIG. 6 is a refrigerant circuit diagram of a still further embodiment of the refrigeration apparatus of the invention.

FIG. 6 shows a still further embodiment in which the extracted liquid refrigerant is decompressed and expanded to absorb heat from the liquid refrigerant at the outlet of the gas-liquid separator 6. More specifically, a heat exchanger 32 for the supercooling is disposed in a liquid refrigerant extraction pipe 30 at the downstream side of a pressure reducer 31. The supercooling heat exchanger 32 is arranged in a heat-exchanging relationship to the liquid refrigerant pipe **7*a* between the outlet of the gas-liquid separator 6 and the second pressure reducer 8. The outlet of the heat exchanger 32 is connected to the compressor 1 through a pipe. 33. According to this arrangement, the refrigerant decompressed by the pressure reducer 31 super-cools the liquid refrigerant coming out of the gas-liquid separator 6 so that only the liquid phase flows through the second pressure reducer 8 and the flow rate of the refrigerant in this pressure reducer is increased. At the same time, the liquid phase of the refrigerant smoothly flows out of the gas-liquid separator 6 so that the rise of the liquid level in the gas-liquid separator 6 is suppressed advantageously. In addition, owing to the super-cooling of the refrigerant, the generation of flash gas is prevented even when the length of the pipe between the gas-liquid separator 6 and the evaporator 9 is large, so that the evaporator can be supplied with the liquid refrigerant at a sufficiently large rate. The super-cooling heat exchanger 32** mentioned above may be constituted by a double-tube type heat exchanger. Other portions are materially identical to those of the first embodiment shown in FIG. 1 and, hence, are denoted by the same reference numerals with the detailed explanation thereof omitted.

Figure 7:
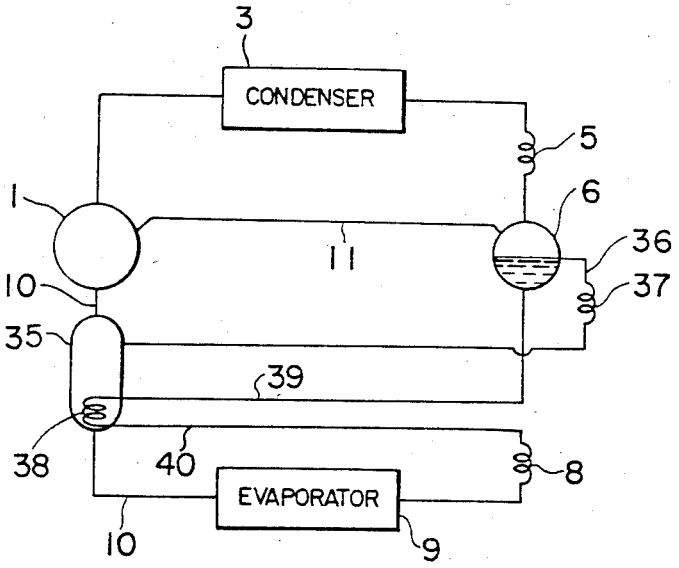
FIG. 7 is a refrigerant circuit diagram of a still further embodiment of the refrigeration apparatus of the invention.

FIG. 7 shows a still further embodiment in which a super-cooling heat exchanger is disposed in an accumulator and a liquid refrigerant extraction pipe is connected to this accumulator. More specifically, in this embodiment, an accumulator 35 is disposed at an intermediate portion of the suction pipe 10 of the compressor 1 and a liquid refrigerant extraction pipe 36 opens into the accumulator 35 through a pressure reducer 37. A super-cooling heat exchanger 38 is disposed in the accumulator 35. The supercooling heat exchanger 38 is connected to the lower end portion of the accumulator 35 where the liquid refrigerant is accumulated, and is connected to the liquid phase portion (lower portion) of the gas-liquid separator 6 and to the second pressure reducer 8 through pipes 39 and 40, respectively. In this embodiment, therefore, the liquid refrigerant coming out of the gas-liquid separator 6 is supercooled by the liquid refrigerant in the accumulator 35. On the other hand, the liquid refrigerant in the accumulator 35 is heated to evaporate, and thus the gaseous refrigerant is sucked by the compressor 1.

Figure 8:
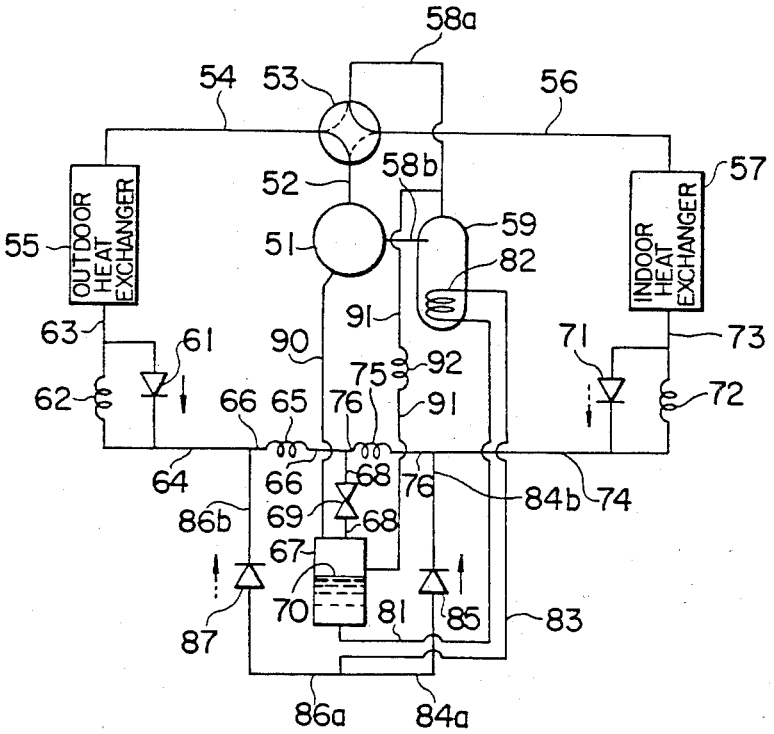
FIG. 8 is a diagram showing a heat-pump type refrigerant circuit of a still further embodiment of the refrigeration apparatus of the invention.

FIG. 8 shows a still further embodiment having a heat-pump type refrigerant circuit for cooling or warming purpose. The discharge pipe 52 of a compressor 51 is connected through a four-way valve 53 to a pipe 54 which leads to an outdoor heat exchanger 55. Another pipe 56 leading from the four-way valve 53 is connected to an indoor heat exchanger 57. Still another pipe 58*a* leading from the four-way valve 53 is connected to an accumulator 59 which in turn is connected through a pipe 58*b* to the suction side of the compressor 51. A parallel passage having a check valve 61 and a second heating pressure reducer 62 connected in parallel to each other has one end connected to the outdoor heat exchanger 55 through a pipe 63 and the other end connected to a pipe 66 of a first cooling pressure reducer 65 through a pipe 64. The other end of the pipe 66 is connected to an inlet pipe 68 to a gas-liquid separator 67. The inlet pipe 68 is connected through a solenoid valve 69 to an upper portion of the gas-liquid separator 67.

Another parallel passage constituted by a check valve 71 and a second cooling pressure reducer 72 connected in parallel to each other has one end connected to the indoor heat exchanger 57 through a pipe 73 and the other end connected through a pipe 74 to a pipe 76 of a first heating pressure reducer 75. The other end of the pipe 76 is connected to the inlet pipe 68 to the solenoid valve 69. A pipe 81 connected to the bottom of the gas-liquid separator 67 is connected to a super-cooling heat exchanger 82 provided in the accumulator 59, while the outlet from the heat exchanger 82 is connected to a pipe 83. The other end of the pipe 83 is branched into two pipes, namely, a pipe 84*a* which is connected through a check valve 85 to a pipe 84*b* connected to the pipe 74, and a pipe 86*a* which is connected through a check valve 87 to a pipe 86*b* connected to the pipe 64.

A gas injection pipe or line 90 has one end opened to the gaseous phase portion formed in the upper portion of the gas-liquid separator 67, while the other end is connected and opened to a compression chamber of the compressor 51.

A reference numeral 91 designates a liquid refrigerant extraction pipe having one end connected through a pressure reducer 92 to the gas-liquid separator 67 so as to open at a predetermined central level of the gas-liquid separator 67. The other end of the liquid refrigerant extraction pipe 91 is connected to the inlet pipe 58*a* to the accumulator 59.

The operation of this embodiment is as follows.

For operating the refrigerant circuit in the cooling mode, the four-way valve 53 is turned to the position shown by a full line in FIG. 8 so that the refrigerant flows in the direction of the full-line arrows. On the other hand, when the refrigerant circuit operates in the heating mode, the four-way valve 53 is turned to the position shown by a broken-line so that the refrigerant flows in the direction indicated by broken-line arrows.

The operation in cooling mode with the gas injection is as follows.

The refrigerant discharged from the compressor 51 is returned to the compressor through a closed loop constituted by the four-way valve 53, pipe 54, outdoor heat exchanger 55, pipe 63, check valve 61, pipe 64, first cooling pressure reducer 65, solenoid valve 69, gas-liquid separator 67, pipe 81, super-cooling heat exchanger 82, pipe 83, pipe 84*a*, check valve 85, pipe 84*b*, pipe 74, second cooling pressure reducer 72, pipe 73, indoor heat exchanger 57, pipe 56, four-way valve 53, pipe 58*a*, accumulator 59 and the pipe 58*b*. The refrigerant changes its phase from gas to liquid and vice versa while it flows through this closed loop thereby effecting the cooling of a fluid in an indoor heat exchanger 57. In this operation, the gaseous refrigerant separated in the gas-liquid separator 67 is injected into the compression chamber of the compressor 51 through the gas injection line 90 to increase the cooling power of the refrigeration cycle. The refrigerant is prevented from flowing through the pipe 66 to the first heating pressure reducer 75, due to a large resistance to the flow of the refrigerant. In the operation, as the liquid level 70 in the gas-liquid separator 67 is raised due to, for example, a load fluctuation, the liquid refrigerant is discharged into the accumulator 59 through the liquid refrigerant extraction pipe 91 and the pressure reducer 92, thereby to stabilize the liquid level in the gas-liquid separator 67. The liquid refrigerant flowing from the gas-liquid separator 67 through the pipe 81 is super-cooled in the super-cooling heat exchanger 82 within the accumulator 59, through a heat exchange with the liquid refrigerant in the accumulator 59. Consequently, the liquid level in the gas-liquid separator 67 is controlled stably and, at the same time, the cooling power of the cycle is increased advantageously.

When the gas injection is not effected, the solenoid valve 69 is kept closed so that the refrigerant does not flow into the gas-liquid separator 67. Accordingly, no rise of the liquid level takes place in the gas-liquid separator 67. In this case, since the solenoid valve 69 is closed, the refrigerant flows from the first cooling pressure reducer 65 to the pipe 74 through the pipe 66, pipe 76, first heating pressure reducer 75 and the pipe 76.

The operation in heating mode with the gas injection is as follows. In this case, the refrigerant discharged from the compressor 51 is returned to the same through a closed loop of the refrigerant passage constituted by the four-way valve 53, pipe 56, indoor heat exchanger 57, pipe 73, check valve 71, pipe 74, first heating pressure reducer 75, solenoid valve 69, gas-liquid separator 67, pipe 81, super-cooling heat exchanger 82, pipe 83, pipe 86*a*, check valve 87, pipe 86*b*, pipe 64, second heating pressure reducer 62, pipe 63, indoor heat exchanger 55, pipe 54, four-way valve 53, pipe 58*a*, accumulator 59 and the pipe 58*b*. The refrigerant flowing in this closed loop makes a phase change from gas to liquid and vice versa to heat a medium in the indoor heat exchanger 57. In this operation, the gas separated in the gas-liquid separator 67 is injected into the compression chamber of the compressor 51 through the gas injection line 90, thereby to increase the heating power of the refrigeration cycle. The refrigerant is prevented from flowing through the pipe 76 into the first cooling pressure reducer 65, due to a large resistance against the flow of refrigerant in the pipe 76.

When the liquid level 70 in the gas-liquid separator 67 is raised due to fluctuation of load, the liquid refrigerant is discharged into the accumulator 59 through the liquid refrigerant pipe 91 and the pressure reducer 92. Meanwhile, the liquid refrigerant flowing out of the gas-liquid separator 67 through the pipe 81 is super-cooled in the super-cooling heat exchanger 82 within the accumulator 59 by the liquid refrigerant in the accumulator 59. Consequently, the liquid level in the gas-liquid separator is stabilized and the heat-exchange in the outdoor heat exchanger is enhanced to increase the heating power of the heat-pump type refrigeration cycle.

When the gas injection is not effected, the refrigerant does not flow into the gas-liquid separator 67, so that the liquid level is not changed substantially. In this case, since the solenoid valve 69 is closed, the refrigerant flows from the first heating pressure reducer 75 to the pipe 64 through the pipe 76, pipe 66, first cooling pressure reducer 65, and the pipe 66.

Figure 9:
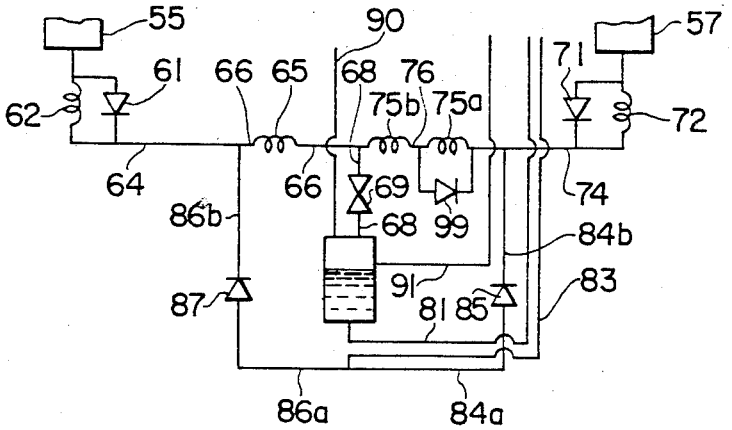
FIG. 9 shows a part of a refrigerant circuit which is a modification of the refrigeration circuit shown in FIG. 8.

FIG. 9 shows a still further embodiment of the invention in which the first heating pressure reducer is divided into two series sections. Namely, in this embodiment, the first heating pressure reducer in the pipe 76 is divided into two pressure reducer sections 75*a* and 75*b* which are connected in series. A check valve 99 is connected in parallel to one 75*a* of the pressure reducer sections.

Other portions are materially identical to those of the embodiment shown in FIG. 8 and, hence, are denoted by the same reference numerals with the detailed explanation thereof omitted.

As stated before, in the embodiment shown in FIG. 9, the refrigerant flows through the first heating pressure reducer constituted by the series of pressure-reducing sections 75*a* and 75*b*, whenever the refrigeration cycle operates in the heating mode, regardless of whether the gas injection is conducted or not. When the cycle operates in the cooling mode without the gas injection, the check valve 99 permits the refrigerant to flow therethrough, so that only the pressure reducer section 75*b* acts to reduce the refrigerant pressure. Consequently, the flow resistance produced by the first pressure reducer during the heating operation, as well as the flow resistance imposed by the pressure reducer during the cooling operation without the gas injection, is optimized. Namely, when the refrigeration cycle operates in the cooling mode without the gas injection, the flow resistance produced by the pressure reducer is decreased by an amount corresponding to the resistance which would be produced by the pressure reducer section 75*a*.

What is claimed is:

1. A refrigeration apparatus having a refrigerant circuit constituted by a compressor,, a condenser, a first pressure reducer, a gas-liquid separator, a second pressure reducer and an evaporator connected to one another in series, and a gas injection line connected between a gaseous phase portion of said gas-liquid separator and a compression chamber of said compressor,. characterized by comprising a liquid refrigerant extracting passage providing a communication between a portion of said gas-liquid separator at a predetermined level and a portion of the low-pressure side of the refrigerant circuit.

2. A refrigeration apparatus according to claim 1, wherein said liquid refrigerant extracting passage has a pressure reducer.

3. A refrigeration apparatus according to claim 2, wherein a plurality of liquid refrigerant extraction pipes are provided to open to said gas-liquid separator at different levels.

4. A refrigeration apparatus according to claim 2, wherein said pressure reducer comprises an expansion valve which operates under the control of a feeler bulb sensitive to the degree of superheating of the refrigerant at the suction side of said compressor.

5. A refrigeration apparatus according to claim 2, wherein said pressure reducer comprises a capillary tube.

6. A refrigeration apparatus according to claim 2, wherein said pressure reducer comprises a float valve disposed in said gas-liquid separator.

7. A refrigeration apparatus according to claim 1, wherein said liquid refrigerant, extracting passage has a pressure reducer and a super-cooler for liquid refrigerant which is disposed at the downstream side of said pressure reducer.

8. A refrigeration apparatus according to claim 7, wherein said super-cooler is a heat exchanger which permits a heat exchange between the liquid refrigerant flowing out of said gas-liquid separator and a refrigerant flowing through the liquid refrigerant extracting passage.

9. A refrigeration apparatus according to claim 7, wherein said super-cooler is an accumulator which is disposed at the suction side of said compressor and has a heat exchanging portion for super-cooling the liquid refrigerant flowing out of said gas-liquid separator by the refrigerant in said accumulator.

10. A refrigeration apparatus according to claim 8, wherein said heat exchanger is a double-tube type heat exchanger.

11. A refrigeration apparatus having a refrigerant circuit, said circuit comprising: a refrigerant passage constituted by a series connection of a compressor, a four-way valve, an outdoor heat exchanger, a second heating pressure reducer with a first check valve connected in parallel thereto, a first cooling pressure reducer, a first heating pressure reducer, a second cooling pressure reducer with a second check valve connected in parallel thereto, and an indoor heat exchanger through pipes; a gas-liquid separator connected through an inlet pipe to said passage between said first cooling pressure reducer and said first heating pressure reducer; pipes having third and fourth check valves and leading from the bottom of said gas-liquid separator to an inlet pipe to said second cooling pressure reducer and to an inlet pipe to said second heating pressure reducer, respectively; an injection line connected between a gaseous-phase portion of said gas-liquid separator and a compression chamber of said compressor; stop valve means disposed in the inlet pipe to said gas-liquid separator and adapted to be opened and closed, respectively, when gas injection to said compressor is made and not made; a change-over means for changing over said four-way valve so as to selectively connect discharge and suction pipes of said compressor to said outdoor heat exchanger and said indoor heat exchanger in such a manner that, when said refrigeration apparatus operates in the cooling mode, a refrigerant passage is formed to connect the outlet side of said outdoor heat exchanger to said gas-liquid separator through said first check valve, first cooling pressure reducer and said stop valve means, and also to connect the bottom portion of said gas-liquid separator to said second cooling pressure reducer through said third check valve whereas, when said refrigeration apparatus operates in the heating mode, a refrigerant passage is formed to connect the outlet side of said indoor heat exchanger to said gas-liquid separator through said second check valve, first heating pressure reducer and said stop valve means and also to connect the bottom portion of said gas-liquid separator to said second heating pressure reducer through said fourth check valve; a first bypass passage means which forms, when said refrigeration apparatus operates in the cooling mode without the gas injection, a passage directly connecting said first cooling pressure reducer to said second cooling pressure reducer bypassing said gas-liquid separator; and a second bypass passage means which forms, when said refrigeration apparatus operates in the heating mode, a passage which directly connects said first heating pressure reducer to said second heating pressure reducer bypassing said gas-liquid separator; wherein the improvement comprises an accumulator disposed in the suction pipe of said compressor; and a liquid refrigerant extraction passage connected at its one end to said gas-liquid separator to open at a predetermined level in said gas-liquid separator and at the other end to a portion of the low-pressure side of said refrigerant circuit; the pipe leading from the bottom portion of said gas-liquid separator to said third and fourth check valves being arranged in said accumulator in such a manner that heat is exchanged between the refrigerant flowing through said pipe leading from the bottom portion of said gas-liquid separator and the refrigerant in said accumulator.

12. A refrigeration apparatus according to claim 11, wherein said liquid refrigerant extraction passage has a pressure reducer.

13. A refrigeration apparatus according to claim 12, wherein said pressure reducer comprises a capillary tube.

14. A refrigeration apparatus according to claim 11, wherein said first heating pressure reducer is constituted by two pressure reducer sections connected in series, and a check valve connected in parallel to one of said pressure reducer section.

* * * * *